US010105743B2

(12) United States Patent
Jarrasch et al.

(10) Patent No.: US 10,105,743 B2
(45) Date of Patent: Oct. 23, 2018

(54) RADIAL PRESS

(71) Applicant: UNIFLEX-HYDRAULIK GMBH, Karben (DE)

(72) Inventors: Heidi Jarrasch, Nieder-Rosbach (DE); Carsten Baumgartner, Laubach (DE)

(73) Assignee: Uniflex-Hydraulik GmbH, Karben (DE)

( * ) Notice: Subject to any disclaimer, the term of this patent is extended or adjusted under 35 U.S.C. 154(b) by 0 days.

(21) Appl. No.: 15/715,713

(22) Filed: Sep. 26, 2017

(65) Prior Publication Data

US 2018/0015523 A1 Jan. 18, 2018

Related U.S. Application Data

(63) Continuation of application No. PCT/EP2016/054798, filed on Mar. 7, 2016.

(30) Foreign Application Priority Data

Apr. 2, 2015 (DE) ..... 10 2015 004 440

(51) Int. Cl.
*B21D 41/04* (2006.01)
*B21D 37/02* (2006.01)
(Continued)

(52) U.S. Cl.
CPC ..... *B21D 37/02* (2013.01); *B21D 39/046* (2013.01); *B21D 39/048* (2013.01); *B21D 41/00* (2013.01);
(Continued)

(58) Field of Classification Search
CPC .... B21D 39/046; B21D 39/048; B21D 41/00; B21D 37/02; B21D 37/145; B21J 9/06; B30B 7/04; B30B 15/02; B25B 27/10
(Continued)

(56) References Cited

U.S. PATENT DOCUMENTS 3,568,495 A * 3/1971 Duffield et al. ..... B21D 41/00 72/402
3,750,452 A * 8/1973 Frank ..... B21D 39/046 29/237

(Continued)

FOREIGN PATENT DOCUMENTS

DE 200 17 791 U1 12/2001
DE 201 09 212 U1 9/2002
EP 1 610 915 B1 4/2010

OTHER PUBLICATIONS

International Search Report issued for corresponding International Patent Application No. PCT/EP2016/054798 dated Jun. 16, 2016.

*Primary Examiner* — David B Jones
(74) *Attorney, Agent, or Firm* — Myers Wolin, LLC

(57) ABSTRACT

A radial press is provided with a base structure, a pressing tool accommodated therein and a drive unit. The pressing tool comprises a number of base jaws which are arranged about a press axis and can be moved by the drive unit towards or away from the press axis in a synchronous manner and radially in relation to said press axis, and substantially wedge-shaped press-jaw heads can be exchangeably attached to the base jaws. A plurality of press-jaw head sets is stored in an associated magazine, the press-jaw head sets being for different press diameters. The press-jaw heads have two markings on at least one axial end side directly adjacent to both wedge surfaces. In addition, the two respective opposing markings of two neighboring press-jaw heads are aligned with one another. Markings that are different from one another are provided for different press-jaw head sets.

15 Claims, 2 Drawing Sheets

(51) Int. Cl.

| | |
|---|---|
| ***B21D 41/00*** | (2006.01) |
| ***B21J 9/06*** | (2006.01) |
| ***B30B 7/04*** | (2006.01) |
| ***B25B 27/10*** | (2006.01) |
| ***B30B 15/02*** | (2006.01) |
| ***B21D 39/04*** | (2006.01) |
| *B21D 37/14* | (2006.01) |

(52) U.S. Cl.
CPC ..... *B21J 9/06* (2013.01); *B25B 27/10* (2013.01); *B30B 7/04* (2013.01); *B30B 15/02* (2013.01); *B21D 37/145* (2013.01)

(58) Field of Classification Search
USPC ..... 72/402
See application file for complete search history.

(56) References Cited

U.S. PATENT DOCUMENTS

| | | | | |
|---|---|---|---|---|
| 4,250,607 | A | 2/1981 | Lillbacka et al. | |
| 6,257,042 | B1 | 7/2001 | Välimäki et al. | |
| 6,845,645 | B2 * | 1/2005 | Bartrom | B21J 9/06 72/15.5 |
| 7,797,979 | B2 * | 9/2010 | Beining | B21D 39/046 72/402 |
| 8,230,714 | B2 * | 7/2012 | Intagliata | B21D 39/048 100/232 |

* cited by examiner

RADIAL PRESS

CROSS REFERENCE TO RELATED APPLICATIONS

This application is a continuation under 35 U.S.C. § 120 of International Application PCT/EP2016/054798, filed Mar. 7, 2016, which claims priority to German Application 10 2015 004 440.0, filed Apr. 2, 2015, the contents of each of which are incorporated by reference herein.

FIELD OF THE INVENTION

The present invention relates to a radial press with a base structure, a press die accommodated therein and a drive unit, wherein the press die comprises several base jaws, which are disposed around a press axis, which by means of the drive unit can be moved on the press axis synchronously toward or away therefrom in radial direction and on which a substantially wedge-shaped press-jaw head can be respectively attached exchangeably, and wherein, furthermore, a plurality of sets of press-jaw heads matched to different press diameters is stored in an associated magazine.

BACKGROUND

Radial presses of the foregoing type, such as used, for example, to make a secure connection between a flexible hydraulic line and a connecting fitting disposed in end position thereon, are known in diverse embodiments, especially from the product program of Uniflex Hydraulik GmbH, Karben (Germany). Therein the magazine in which the sets of press-jaw heads matched to different press diameters are stored is mounted in the frame of the radial press, as may also be inferred, for example, from U.S. Pat. No. 6,257,042 B1. In U.S. Pat. No. 4,250,607 A, a revolver magazine is alternatively proposed.

In view of good results of radial-press operation, the press dies typically have eight base jaws and the sets of press-jaw heads are relatively closely spaced. In other words, correspondingly many sets of press-jaw heads, to be stored in the magazine and containing (typically eight) press-jaw heads that respectively differ only slightly from one another, are present on the radial press.

To exchange the complete sets of press-jaw heads in order to change the radial press over from one press diameter to another, special dies are usually used, for example according to DE 20109212 U1 or EP 1610915 B1. Nevertheless, individual removal or individual mounting of the press-jaw heads is often unavoidable.

This leads to the potential hazard that very similar press-jaw heads are inadvertently confused for one another, for example in the case that a set of press-jaw heads comprising eight press-jaw heads contains one undersized or oversized press-jaw head. Since the press-jaw heads hardly differ from one another, this frequently goes unnoticed. The press operation executed with such an (assumed) "set of press-jaw heads" is defective, however, and does not fulfill the requirements imposed on it. This may even lead to such defective press operations that, when the workpieces in question are used, they represent a hazard for the environment due to malfunction or failure of the workpiece in question.

It has been proposed (see DE 20017791 U1) that the press-jaw heads (especially eight) of a set of press-jaw heads be interconnected with one another to form an inseparable combination. In this way, the inadvertent confusion of press-jaw heads alluded to (theoretically) in the foregoing can be prevented. Nevertheless, as explained hereinabove, the removal of individual press-jaw heads from the base jaws or the mounting of individual press-jaw heads on the base jaws is often unavoidable, and so the joining of the press-jaw heads together as a combination does not lead unconditionally to the desired objective.

SUMMARY

The object of the present invention is to provide a radial press of the class in question that is improved compared with the problem of the prior art discussed in the foregoing.

This stated object is achieved according to embodiments of the present invention by providing, in a radial press of the class in question, that the press-jaw heads have two markings on at least one axial end face directly adjoining two wedge faces, wherein the two oppositely disposed markings of two neighboring press-jaw heads are respectively aligned with one another and wherein, furthermore, markings that are different from one another are provided for different sets of press-jaw heads. In this way the inventive radial press is characterized by specific markings provided on respectively at least one of the end faces of the press-jaw heads, wherein respectively two markings provided on press-jaw heads neighboring one another are oppositely disposed in alignment with one another due to the arrangement of the markings directly adjoining the wedge faces of the press-jaw heads. This ensures that, by means of optical control, it is easily detected whether or not all press-jaw heads mounted on the base jaws belong to the same set of press-jaw heads, in which case the press die is expediently brought, for this optical control, into the completely closed position, in which press-jaw heads neighboring one another are in contact with one another.

In a preferred embodiment, the markings of the press-jaw heads of each set of press-jaw heads are constructed identically to one another. This is the case in particular when the installation position of the individual press-jaw heads on the base jaws of the radial press is unimportant, especially because all press-jaw heads of the set of press-jaws in question are absolutely identical. If this is not the case, however, then—according to another preferred embodiment, to be explained hereinafter—the markings of the individual press-jaw heads of each set of press-jaw heads are constructed differently from one another.

If the markings of the press-jaw heads of each set of press-jaw heads are constructed identically to one another, the markings of the various sets of press-jaw heads differ from one another, preferably at least with respect to their distance to the (radially outward) contact face on which the press-jaw heads bear on the base jaws. Thus—during the said optical control—the two oppositely disposed markings of two neighboring press-jaw heads are respectively in alignment, provided the two press-jaw heads in question belong to the same set of press-jaw heads. However, if the two press-jaw heads in question belong to different sets of press-jaw heads, the two oppositely disposed markings will not be in alignment with one another, but instead will be (more or less) radially offset relative to one another. Such a radial offset of the markings of neighboring press-jaw heads will be easily perceived, and so the attachment of an incorrect press-jaw head, i.e. a press-jaw head that is undersized or oversized compared with the other press-jaw heads, will not go unnoticed.

In a preferred embodiment, the two markings of each press-jaw head are respectively part of a linear marking that extends at least substantially between the two wedge faces.

Particularly preferably, the linear markings respectively extend continuously from one wedge face to the other, and so, in a completely closed press die, a continuous marking line is visible in the end faces in the region of the press-jaw heads. This increases the obviousness of an erroneous setup of the base jaws, i.e. the mounting of a press-jaw head that does not match the other press-jaw heads, and in this way contributes to a particularly low risk of undetected erroneous setup of the radial press. In the case that the markings of all sets of press-jaw heads are identical (see above), the continuous marking line has a completely closed shape. If the individual marking lines of the press-jaw heads are configured substantially as circular-arc segments, the resulting closed marking line of the entire set of press-jaw heads may be circular. Other particularly suitable closed marking lines are regular polygons, for example octagons.

Alternatively or in addition to the different arrangement, discussed hereinabove, of the markings or marking lines of the various sets of press-jaw heads, at least with respect to their distance to the contact face on which the press-jaw heads bear on the base jaws, the marking lines may also differ in particular with respect to their shape. Thus, for example, the marking lines may be curved arcuately outward, linear and curved arcuately inward. Thus a press-jaw head that does not belong to the other press-jaw heads will become immediately obvious due to the shape of its marking line. In this connection it would even be harmless if the shape of the marking line were to be used again in every third set of press jaws; in such a case the erroneously set-up press-jaw head would be obvious due to its dimensioning, which would differ considerably from that of the other press-jaw heads.

According to another preferred embodiment, the linear markings comprise groove-like depressions machined into the end face in question of the respective press-jaw head, or else raised ridges disposed on the end face in question of the respective press-jaw head. This does not merely increase the optical perceptibility of a possible erroneous setup. To the contrary, such a possibility can also be (additionally) felt. This is expedient for reliability of control of proper setup of the radial press.

According to yet another preferred embodiment, the markings of the individual sets of press-jaw heads each have substantially the same distance to the press face, provided all press-jaw heads of a set of press-jaw heads are constructed identically. Thus the markings directly reflect the press diameter to which the individual press-jaw heads are matched. In view of even better perceptibility of an erroneous setup, however, in an alternative preferred configuration the markings of the press-jaw heads for a larger press diameter have a larger distance to the press face than the press-jaw heads for a smaller press diameter. In this way, it is particularly obvious—in the case of an erroneous set-up—from the somewhat exaggerated offset of the markings relative to one another that one of the press-jaw heads does not match the others.

Likewise in the interests of particularly marked obviousness of an erroneous set-up, the markings of the individual sets of press-jaw heads may be distinguished from one another by color.

It has already been explained hereinabove that—according to a preferred embodiment—the markings of the individual press-jaw heads of each set of press-jaw heads may be constructed differently from one another. This improvement is advantageously used when the installation position of the individual press-jaw heads on the base jaws of the radial press is unimportant, especially because the press-jaw heads of the set of press-jaws in question are not absolutely identical. This is the case, for example, when the individual press-jaw heads of the set of press-jaw heads in question have a specific ground section, so that the entirety of the press faces (when the radial press is closed) do not define an ideal circular cylinder.

In this case also, the two markings of each press-jaw head may respectively be part of a linear marking extending continuously from one wedge face to the other, and so, in a completely closed press die, a marking line extending over all press-jaw heads is visible in the end faces. In this connection, the continuous marking line in question—which is visible when the press die is completely closed—may have the shape of a spiral, for example. An obvious deviation of the marking from its nominal shape, in other words a continuous marking line, will then occur both in the case of an erroneous setup of the set of press-jaw heads with a press-jaw head that does not belong thereto, and in the case of an arrangement that differs from the specified arrangement of the individual press-jaw heads of the set of press-jaw heads relative to one another.

Finally, it must be pointed out that the press-jaw heads may have, both wedge faces, two directly adjoining markings on both axial end faces, wherein the two oppositely disposed markings of two neighboring press jaw heads are respectively aligned with one another on each of the two end faces. In this connection, if the press-jaw heads are asymmetrically configured, so that they can be attached in two different installation positions on the base jaws, it is particularly preferable to construct the markings of the press-jaw heads differently at each of the two end faces. In this way it can be easily detected by optical control when one of the press-jaw heads is mounted in an installation position different from that of the other press-jaw heads.

BRIEF DESCRIPTION OF THE DRAWINGS

The present invention will be explained in more detail hereinafter on the basis of several preferred exemplary embodiments. In this connection

DETAILED DESCRIPTION OF THE PREFERRED EMBODIMENTS

Figure 1:
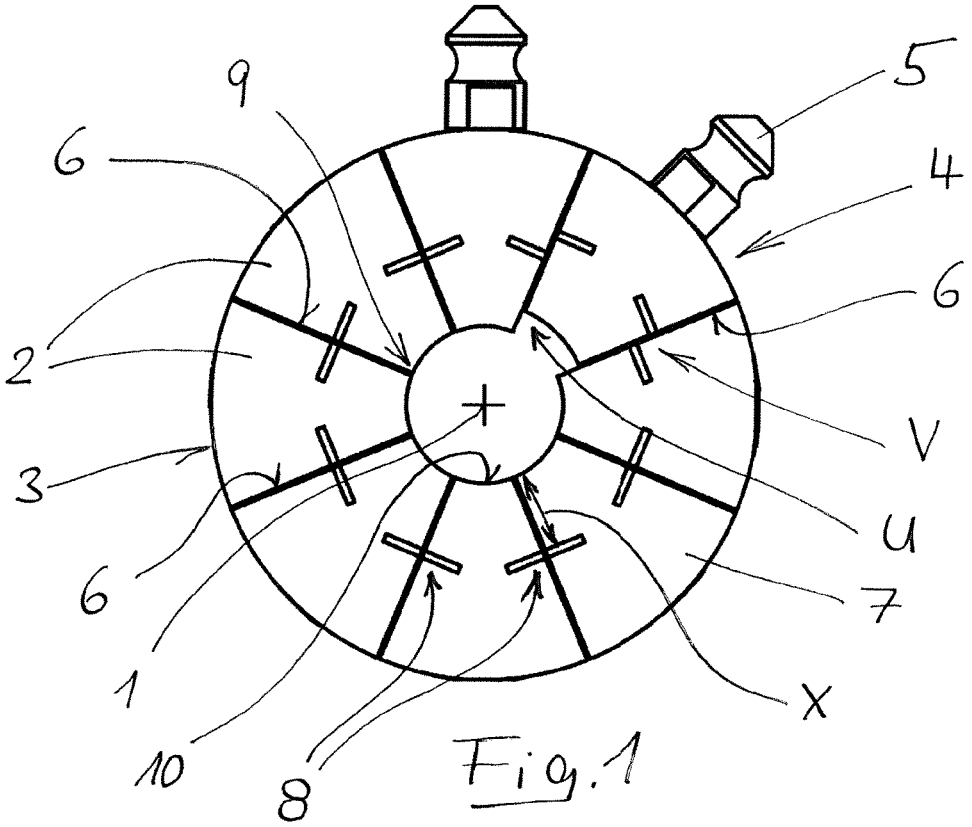
FIG. 1 shows, in an overhead view of the end face, a set of press-jaw heads according to a first embodiment of the invention, erroneously set up with one undersized press-jaw head.
Figure 2:
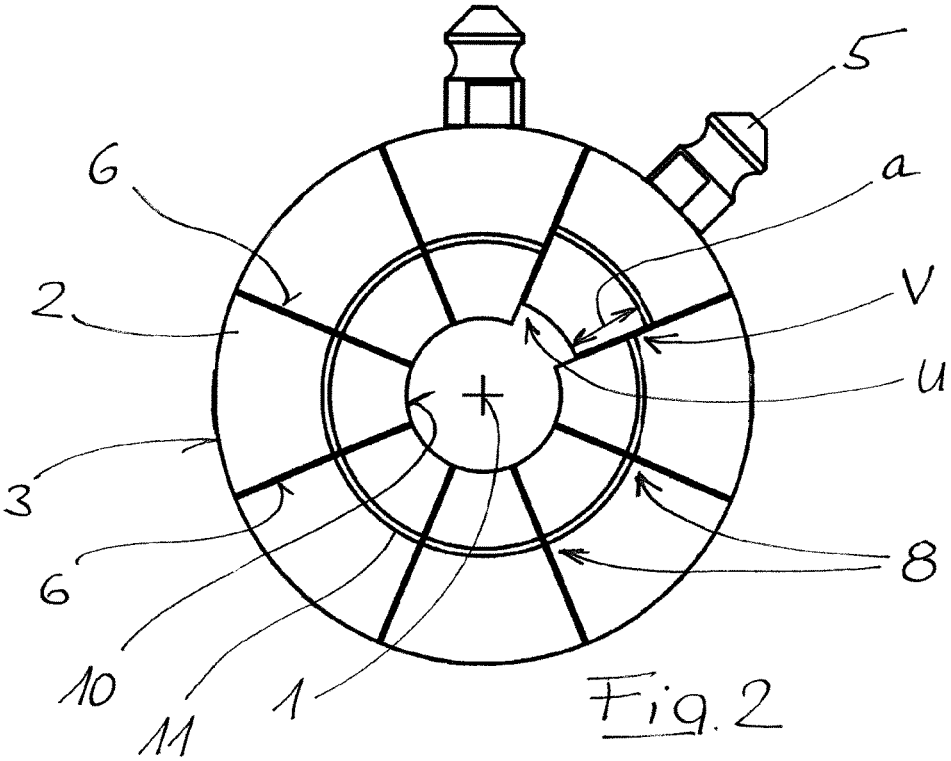
FIG. 2 shows, in an overhead view of the end face, a set of press-jaw heads according to a second embodiment of the invention, likewise erroneously set up with one undersized press-jaw head.
Figure 3:
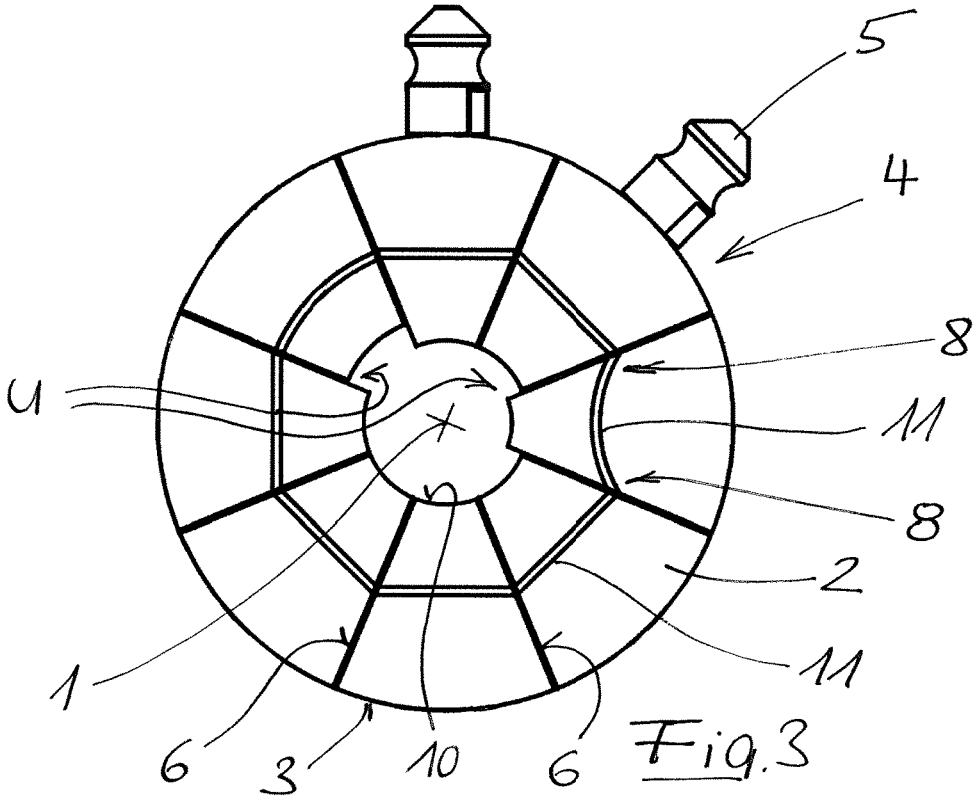
FIG. 3 shows, in an overhead view of the end face, a set of press-jaw heads according to a third embodiment of the invention, erroneously set up with one undersized press-jaw head as well as with one oversized press-jaw head.

Because, depending on their type, radial presses on which the present invention can be implemented have long been known—at least to the persons skilled in this particular art—the illustration of the exemplary embodiments will be limited to the respective set of press-jaw heads erroneously set-up in FIGS. 1 to 3 respectively.

FIG. 1 illustrates eight wedge-shaped press-jaw heads 2, which are disposed around press axis 1, and which, for their exchangeable attachment to the eight base jaws of the respective radial press, are respectively equipped on their radial outer face 4—forming the face of contact 3 with the associated base jaw—with a snap-in pin 5. These press-jaw heads 2 are illustrated in that configuration that they occupy with maximally closed press die, in which, in particular, the wedge faces 6, respectively disposed opposite one another, of two neighboring press-jaw heads are in contact with one another.

At the illustrated axial end faces 7, press-jaw heads 2 respectively have, on the two wedge faces 6, two directly adjoining markings 8. These markings 8 have the same distance x to each edge 9, at which wedge faces 6 in question and press face 10 of press-jaw 2 in question respectively abut against one another. In this way the oppositely disposed markings 8 of two identically constructed press-jaw heads 2 belonging to the same set of press-jaw heads are respectively in alignment. However, an offset V exists between markings 8 of two press-jaw heads 2 that do not belong to the same set of press-jaw heads. This corresponds to difference U in specified press radius, but is more obvious.

According to FIG. 2, the two adjoining markings 8 of each press-jaw head 2 on the wedge faces in question are respectively part of a linear marking 11 that extends continuously between the two wedge faces 6. This marking line 11 is constructed as a circular-arc segment and, in fact, is concentric with press axis 1. For particularly marked obviousness of an erroneous setup, markings 8 (and accordingly marking lines 11) of press-jaw heads 2 for a larger press diameter have a larger distance a to press face 10 here than press-jaw heads 2 for a smaller press diameter. Thus offset V of marking lines 11 of two neighboring press-jaw heads 2, which do not belong to the same set of press-jaw heads, is correspondingly larger and more obvious than the difference U of press faces 10 relative to one another.

FIG. 3 illustrates the possibility that marking lines 11 of press-jaw heads 2 that belong to different sets of press-jaw heads differ obviously from one another in terms of shape.

Figure 4:
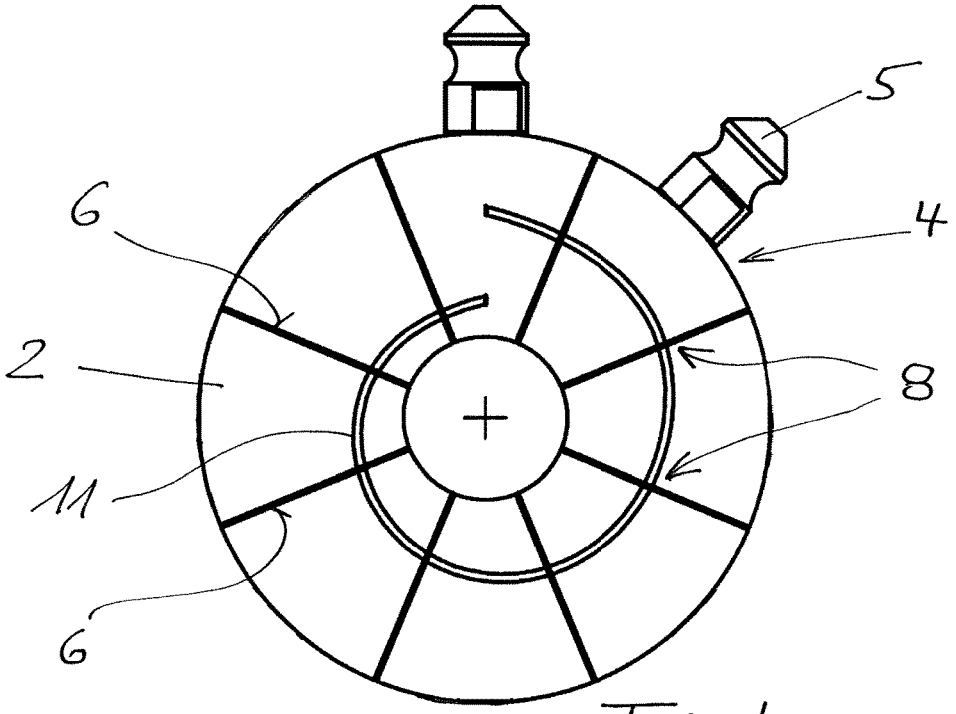
FIG. 4 shows, in an overhead view of the end face of a correctly set-up set of press-jaw heads according to a fourth embodiment of the invention, in compliance with a specified arrangement of the press-jaw heads.

In the embodiment illustrated in FIG. 4, the two markings 8 provided at the end face on all press-jaw heads 2 are again part of a linear marking 11 respectively extending continuously from one edge face 6 to the other. However, linear markings 11 of the individual press-jaw heads 2 are not identical here, but to the contrary are constructed differently from one another. It is only in the correct arrangement of the eight press-jaw heads 2 shown in FIG. 4 that linear markings 11 of press-jaw heads 2 together form (when the press die is completely closed) a continuous marking line that extends over all press-jaw heads 2. In contrast, in each of the assemblies of press-jaw heads 2 differing from the specified arrangement, the marking line is discontinuous, as in the case of an erroneous setup.

Obviously it is possible, in all illustrated and explained improvements, to achieve additional obvious differentiability, either by different coloration of the marking lines of different press-jaw heads and/or by constructing the marking lines as depressed grooves or raised ridges.

What is claimed is:

1. A plurality of sets of press-jaw heads for a radial press comprising:

a first set of several substantially wedge-shaped press-jaw heads; and a second set of several substantially wedge-shaved press-jaw heads, wherein, when used in a press die, several substantially wedge-shaped press-jaw heads of a set of press-jaw heads are disposed around a press axis (1), and wherein, each set of the plurality of sets of press-jaw heads are matched to different press diameters, wherein, when used in a press die, each of the press-jaw heads (2) of the first set have two markings (8) on at least one substantially wedge-shaped end face (7) directly adjoining two wedge faces (6) of neighboring press-jaw heads, wherein two oppositely disposed markings (8) of neighboring press jaw heads (2) are respectively aligned with one another, and wherein, furthermore, markings (8) that are different from those of the first set are provided for the second set of press-jaw heads.

2. The plurality of sets of press-jaw heads of claim 1, wherein the markings (8) of each of the press-jaw heads (2) of the first set of several substantially wedge-shaped press-jaw heads are constructed identically to one another.

3. The plurality of sets of press-jaw heads of claim 2, wherein the markings (8) of the first set of press-jaw heads differ from the markings of the second set of press-jaw heads, at least with respect to a radial distance to a contact face (3) at an outer circumference of the set of press jaws when used in a press die.

4. The plurality of sets of press-jaw heads of claim 2, wherein the two markings (8) of each press-jaw head are respectively part of a linear or curvilinear marking (11) that extends at least substantially between the two wedge faces (6).

5. The plurality of sets of press-jaw heads of claim 4, wherein the linear or curvilinear markings (11) respectively extend continuously from one wedge face (6) to the other, and so, when in use in a press die, the set of press-jaw heads are compressed together and a continuously closed marking line is visible at the end faces of the respective press-jaw heads.

6. The plurality of sets of press-jaw heads of claim 4, wherein the linear or curvilinear markings (11) comprise groove-like depressions machined into the end faces (7) of the respective press-jaw heads (2).

7. The plurality of sets of press-jaw heads of claim 4, wherein the linear or curvilinear markings (11) comprise raised ridges disposed on the end faces (7) of the respective press-jaw heads (2).

8. The plurality of sets of press-jaw heads of claim 4, wherein the linear or curvilinear markings (11) are constructed substantially as curvilinear circular-arc segments.

9. The plurality of sets of press-jaw heads of claim 2, wherein the markings (8) of the individual sets of press-jaw heads respectively have a substantially similar radial distance (x) to a press face (10).

10. The plurality of sets of press-jaw heads of claim 2, wherein the markings (8) of the first set of press jaw heads (2) for a first press diameter have a larger radial distance (a) to a press face (10) than the markings of the second set of press-jaw heads (2) for a second press diameter smaller than the first press diameter.

11. The plurality of sets of press-jaw heads of claim 1, wherein the markings (8) of the a first press-jaw head (2) of the first set of press-jaw heads is constructed or located differently from the markings of a second press-jaw head of the first set of press jaw heads.

12. The plurality of sets of press-jaw heads of claim 11, wherein the markings (8) of each press-jaw head (2) are respectively part of a curvilinear marking (11) extending continuously from one wedge face (6) of one press-jaw head to a wedge face of a second press-jaw head, and so, when in use in a press die, the set of press-jaw heads are compressed together and a marking line extending over all press-jaw heads (2) is visible in the end faces.

13. The plurality of sets of press-jaw heads of claim 1, wherein the press-jaw heads (2) have two markings (8) on each of two wedge shaped end faces (7) immediately adjacent both wedge faces, wherein the corresponding markings (8) of neighboring press-jaw heads (2) are respectively aligned with one another on each of the two corresponding end faces.

14. The plurality of sets of press-jaw heads of claim 11, wherein the markings (8) of the press-jaw heads are respectively constructed or located differently at the two end faces.

15. The plurality of sets of press-jaw heads of claim 1, wherein the markings (8) of the individual sets of press-jaw heads are distinguished from one another by color.

* * * * *